US005713825A

United States Patent [19]

Ratzel

[11] Patent Number: 5,713,825

[45] Date of Patent: Feb. 3, 1998

[54] CUSHIONING CONVERSION MACHINE AND METHOD FOR CONVERTING STOCK MATERIAL INTO A DUNNAGE PRODUCT HAVING A CASING AND A STUFFING WITHIN THE CASING

[75] Inventor: Richard O. Ratzel, Westlake, Ohio

[73] Assignee: Ranpak Corp., Concord Township

[21] Appl. No.: 487,018

[22] Filed: Jun. 7, 1995

[51] Int. Cl.[6] ..... B31F 1/10

[52] U.S. Cl. ..... 493/464; 493/967

[58] Field of Search ..... 493/464, 467, 493/380, 379, 381

[56] References Cited

U.S. PATENT DOCUMENTS

| | | | |
|---|---|---|---|
| 1,989,794 | 2/1935 | Duvall . | |
| 2,273,162 | 2/1942 | Willard . | |
| 2,721,709 | 10/1955 | Auerbacher . | |
| 2,882,802 | 4/1959 | Walker . | |
| 2,935,002 | 5/1960 | Robinson, Jr. . | |
| 3,238,852 | 3/1966 | Schur et al. . | |
| 3,325,120 | 6/1967 | Brinkman . | |
| 3,509,797 | 5/1970 | Johnson . | |
| 3,603,216 | 9/1971 | Johnson . | |
| 3,613,522 | 10/1971 | Johnson . | |
| 3,789,757 | 2/1974 | Motter et al. . | |
| 3,899,166 | 8/1975 | Behn . | |
| 4,026,198 | 5/1977 | Ottaviano . | |
| 4,085,662 | 4/1978 | Ottaviano . | |
| 4,237,776 | 12/1980 | Ottaviano . | |
| 4,557,716 | 12/1985 | Ottaviano . | |
| 4,717,613 | 1/1988 | Ottaviano . | |
| 4,750,896 | 6/1988 | Komaransky et al. . | |
| 4,839,210 | 6/1989 | Komaransky et al. . | |
| 4,884,999 | 12/1989 | Baldocci . | |
| 4,968,291 | 11/1990 | Baldocci et al. . | |
| 5,061,543 | 10/1991 | Baldacci | 428/126 |
| 5,088,972 | 2/1992 | Parker . | |
| 5,123,889 | 6/1992 | Armington et al. . | |
| 5,173,352 | 12/1992 | Parker . | |
| 5,188,581 | 2/1993 | Baldacci | 493/381 |
| 5,194,315 | 3/1993 | Itoh | 493/967 |
| 5,340,638 | 8/1994 | Sperner | 493/967 |
| 5,382,190 | 1/1995 | Graves | 452/21 |

*Primary Examiner*—Joseph J. Hail, III
*Assistant Examiner*—Christopher W. Day
*Attorney, Agent, or Firm*—Renner, Otto, Boisselle & Sklar, P.L.L.

[57] ABSTRACT

A cushioning conversion machine and method for converting multiple layer of sheet-like stock material into a cushioning product, characterized by a first shaping device which shapes a first layer of the stock material into a casing with the lateral edge portions being brought into overlapping relationship one inside the other, a second shaping device which shapes at least one second layer of the stock material into a stuffing for the for the casing, a connecting assembly downstream of the first shaping device for connecting the overlapped lateral edge portions of the first layer separate from the stuffing, and an inner feed assembly downstream of the second shaping device for feeding the second layer into the interior of the casing. The machine further comprises an outer feed assembly for engaging and feeding a central portion of the first layer, the outer and connecting assemblies being cooperative to pull the first layer through the first shaping device. The inner feed assembly is mounted to the downstream ends of cantilevered supports extending through the first shaping device from an upstream end thereof.

42 Claims, 8 Drawing Sheets

CUSHIONING CONVERSION MACHINE AND METHOD FOR CONVERTING STOCK MATERIAL INTO A DUNNAGE PRODUCT HAVING A CASING AND A STUFFING WITHIN THE CASING

FIELD OF THE INVENTION

The herein described invention relates generally to a cushioning conversion machine and method for converting sheet-like stock material into a cushioning product, and a resultant novel cushioning product.

BACKGROUND OF THE INVENTION

In the process of shipping an item from one location to another, a protective packaging material is typically placed in the shipping case, or box, to fill any voids and/or to cushion the item during the shipping process. Some conventional protective packaging materials are plastic foam peanuts and plastic bubble pack. While these conventional plastic materials seem to adequately perform as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a very popular alterative. Paper is biodegradable, recyclable and renewable, making it an environmentally responsible choice for conscientious industries.

While paper in sheet form could possibly be used as a protective packaging material, it is usually preferable to convert the sheets of paper into a relatively low density pad-like cushioning dunnage product. This conversion may be accomplished by a cushioning conversion-machine/method, such as those disclosed in U.S. Pat. Nos. 3,509,798, 3,603,216, 3,655,500, 3,779,039, 4,026,198, 4,109,040, 4,717,613 and 4,750,896, and also in pending U.S. patent applications Nos. 07/533,755, 07/538,181, 07/592,572, 07/734,512, 07/786,573, 07/840,306 and 07/861,225.

With most, if not all, of the conversion machines/methods disclosed in the above-identified patents and applications, the cushioning product is created by converting multi-layer, and preferably three-layer, paper stock material into a desired geometry. The cushioning product includes pillow-like portions formed by the lateral edges of all of the layers of stock paper being rolled inwardly to form a pair of twin spirals. The central regions of this structure are then compressed and connected (such as by coining) to form a central compressed portion and two lateral pillow-like portions which essentially account for the cushioning qualities of the product.

The central compressed portion of such a cushioning product is believed to be necessary to ensure that the pillow-like portions optimally maintain their cushioning qualities. In other words, without a connection of this type, the resiliency of the pillow-like portions would encourage the twin spirals to "unwind." However, the central portion, due to its compressed state, increases the density of the overall cushioning product.

In the past, attempts have been made to decrease the density of the cushioning products by altering its construction. Specifically, U.S. Pat. No. 4,717,613 introduced a conversion process/machine which creates a lower density cushioning product. The decrease in density is accomplished by urging the stock material outwardly into the pillow-like portions whereby the central compressed section is comprised of a lesser amount of stock material.

Despite past improvements, a need remains for conversion machines/methods which create paper cushioning products of even lower densities. Moreover, irrespective of particular density properties, environmental and other concerns provide a constant desire for new and effective paper cushioning products and for machines/methods for creating such products.

SUMMARY OF THE INVENTION

The present invention provides a cushioning conversion machine and method for converting multiple layer of sheet-like stock material into a cushioning product. The construction of the cushioning product is such that the product's overall density is relatively low while at the same time the integrity of the product's cushioning qualities are maintained. Moreover, the cushioning product of the present invention may be, and preferably is, made of paper which is biodegradable, recyclable and renewable. Accordingly, the present invention provides an environmentally responsible alternative to plastic packaging products.

In accordance with the invention, a cushioning conversion machine for converting sheet-like stock material into a dunnage product comprises a first shaping device which shapes a first layer of the stock material into a casing with the lateral edge portions being brought into overlapping relationship one inside the other, a second shaping device which shapes at least one second layer of the stock material into a stuffing for the for the casing, a connecting assembly downstream of the first shaping device for connecting the overlapped lateral edge portions of the first layer separate from the stuffing, and an inner feed assembly downstream of the second shaping device for feeding the second layer into the interior of the casing. Preferably, the machine further comprises an outer feed assembly for engaging and feeding a central portion of the first layer, the outer and connecting assemblies being cooperative to pull the first layer through the first shaping device.

In a preferred embodiment of the invention, the outer feed assembly and the connecting assembly engage the first layer at transversely aligned locations relative to a movement path of the first layer. The connecting assembly includes a pair of rotating connecting members forming therebetween a nip through which the overlapped lateral edge portions of the first layer pass, the outer feed assembly includes a pair of rotating feed members forming therebetween a nip through which the central portion of the first layer passes, and the inner feed assembly includes a pair of rotating crumpling members forming therebetween a nip though which the second layer or layers pass and are crumpled thereby. The rotating crumpling members of the inner feed assembly are mounted to downstream ends of respective supports attached in cantilever-like manner to a frame structure of the machine. The supports respectively extend on opposite sides of the second shaping device from an upstream end of the first shaping device to a downstream end of the first shaping device, and an inner one of the rotating connecting members of the connecting assembly and an inner one of the rotating feed members of the outer feed assembly are respectively mounted to the downstream ends of the supports. The rotating crumpling members of the inner feed assembly are driven by the rotating members of either the outer or connecting assemblies, which have the outer rotating member thereof driven by a feed motor.

Further in accordance with a preferred embodiment of the invention, an outer one of the rotating connecting members or an outer one of the rotating feed members is mounted to the frame for movement transversely to the path of the stock material. The outer connecting or feed member is resiliently biased towards the inner connecting or feed member for resiliently constraining the downstream end of a respective one of the supports against movement away from the downstream end of the other support, whereby one of the rotating crumpling members of the inner feed assembly will be resiliently constrained against movement away from the other crumpling member.

Also in a preferred embodiment of the invention, the first shaping device includes a folding device having converging side walls and respective wings inwardly turned toward one another, the wings being overlapped and spaced apart. An outer one of the overlapped wings defines with an inner one of the wings a first area for receiving one edge portion of the first layer of stock material, and the second shaping device has a surface defining with the inner one of the wings a second area for receiving an opposite edge portion of the first layer. The folding device further includes an inner folder surface and an outer center guide surface extending laterally between the side wall and defining therebetween a passage for the central portion of the first layer, and the inner folder surface has side edges spaced from the side walls. Preferably, there are provided at least one roller which holds the first layer against an upstream end portion of the inner folder surface and edge guides extending generally perpendicular to the inner folder surface and spaced from the side edges of the inner folder surface at a location downstream of the upstream end portion of the inner folder surface and upstream of the side walls of the folding device.

Still in accordance with a preferred embodiment of the invention, the second shaping device includes a converging chute and a former which cooperate to turn inwardly the edges of the second layer to form a pillow-like stuffing. The converging chute may be mounted between the aforesaid cantilevered supports.

According to another broad aspect of the invention, there is provided a cushioning product comprising at least one inner layer of sheet-like material having portions thereof folded upon themselves to produce a stuffing, and an outer layer of sheet-like material formed into a tube surrounding the stuffing and having lateral edge portions overlapped and stitched together separate from the stuffing. The overlapped lateral edge portions are generally coplanar with adjacent unoverlapped portions of the first layer, and the layers of sheet-like material comprise biodegradable, recyclable and reusable Kraft paper.

According to a further broad aspect of the invention, a method for converting sheet-like stock material into a dunnage product comprises the steps of shaping a first layer of the stock material into a tube with the lateral edge portions being brought into overlapping relationship, connecting the overlapped lateral edge portions of the first layer to form a tubular casing, shaping at least one second layer of the stock material into a stuffing for the for the casing, and feeding the stuffing into the interior of the casing. The overlapped lateral edge portions are generally coplanar with adjacent unoverlapped portions of the first layer during the connecting step, i.e., one is disposed inside the other relative to the center axis of the tubular casing. The method also has provision for supplying a plurality of layers as a multi-ply stock material and then separating the layers before the shaping steps.

The foregoing and other features of the invention are hereinafter fully described and particularly pointed out in the claims, the following description and annexed drawings setting forth in detail a certain illustrative embodiment of the invention, this embodiment being indicative, however, of but one of the various ways in which the principles of the invention may be employed.

DETAILED DESCRIPTION

Figure 1:
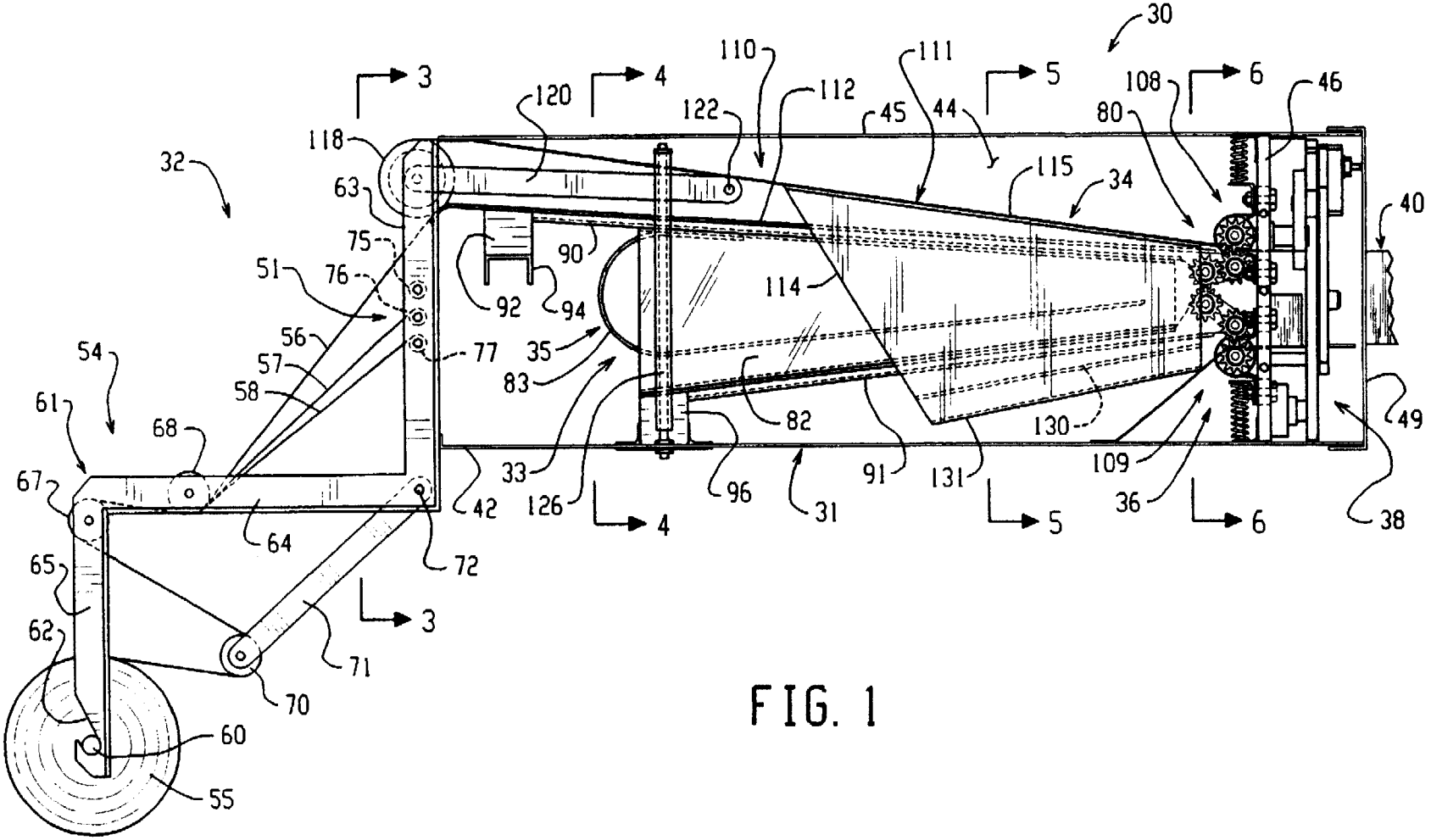
FIG. 1 is a side view of a cushioning conversion machine according to the invention with the side wall of the machine's housing nearest the viewer broken away to permit viewing of internal machine components.
Figure 2:
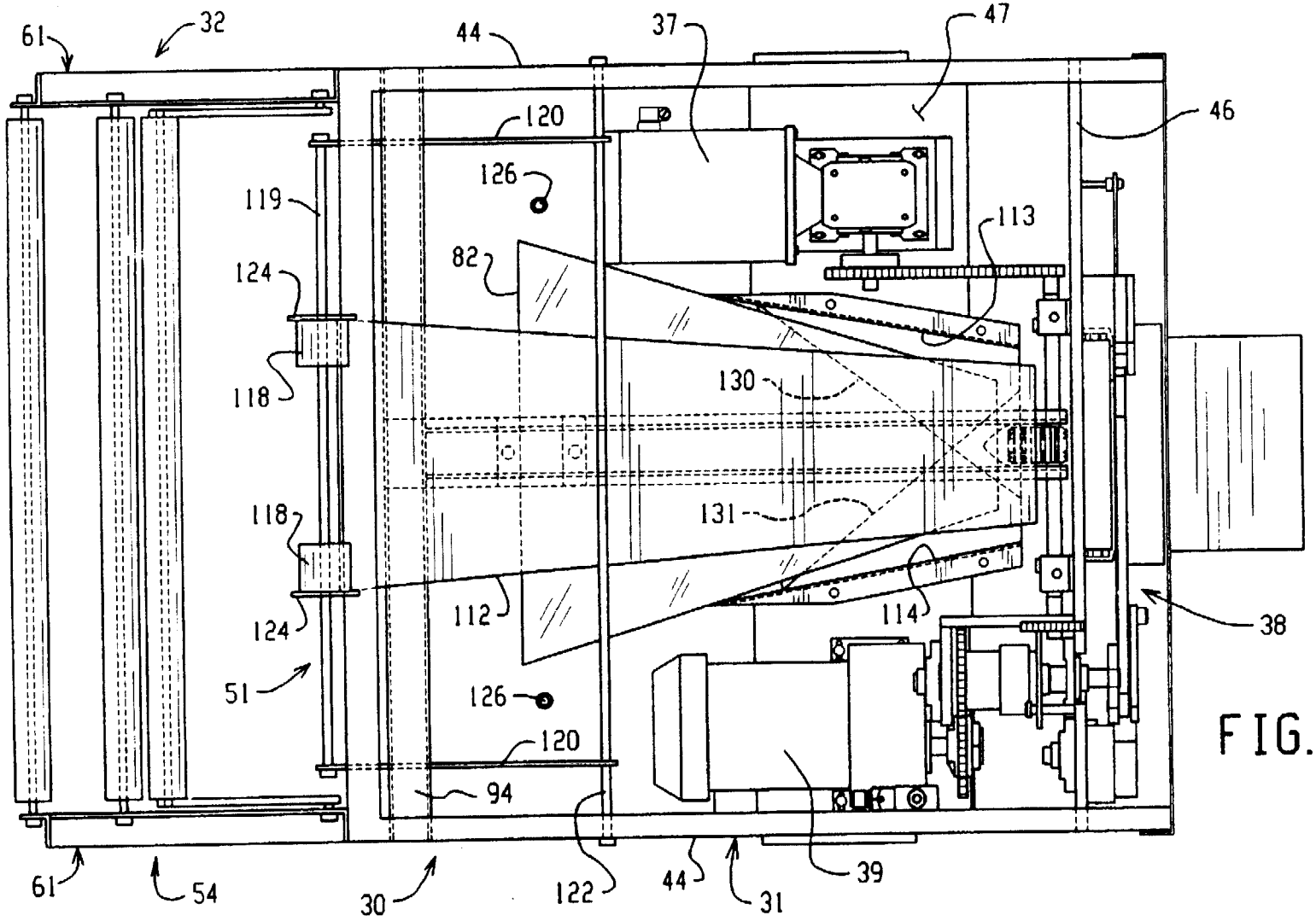
FIG. 2 is a plan view of the conversion machine with the wall of the housing nearest the viewer broken away to permit viewing of internal machine components.

Referring now to FIGS. 1 and 2, an exemplary embodiment of a cushioning conversion machine according to the invention is designated generally by reference numeral 30. The machine includes a housing 31 which forms the structural skeleton for the conversion assemblies of the machine 30. The conversion assemblies include a stock supply assembly 32, a forming assembly 33 composed of an outer shaping assembly 34 and an inner shaping assembly 35, feed assemblies 36 powered by a feed motor 37, a cutting assembly 38 powered by a cut motor 39, and a post-cutting constraining assembly 40. These assemblies of the machine 30 cooperate to convert sheet-like stock material into a cushioning product according to the present invention. The roles the conversion assemblies and components thereof play in the creation of such a cushioning product are explained below in detail. In regard to the various functions performed by the noted assemblies and components thereof, the terms (including a reference to a "means") used to identify the herein-described assemblies and devices are intended to correspond, unless otherwise indicated, to any assembly/device which performs the specified function of such an assembly/device, that is functionally equivalent even though not structurally equivalent to the disclosed structure which performs the function in the illustrated exemplary embodiment of the invention.

The illustrated machine 30, representing a preferred embodiment of the invention, is designed to convert multi-layer stock material into a cushioning product. Preferably, the stock material comprises at least two and preferably three or more superimposed layers which may be supplied in the form of a stock roll. These layers are each preferably 27–30 inches wide, and comprised of biodegradable, recyclable and reusable 30–50 pound Kraft paper.

The housing 31 includes a base plate or wall 42, side plates or walls 44, and an end plate or wall 46 which collectively form a frame structure to which the conversion assemblies of the machine are mounted. The base wall 42 is generally planar and rectangular in shape. The housing also includes a top wall 45, which together with the base, side and end walls, form an enclosure. All or a part of the top wall may be in the form of an openable cover for permitting easy access to the components of the machine located inside the housing. As shown in FIG. 2, the motors 37 and 39 are mounted on the base wall 42 which may be provided with a transverse mounting plate 47 which forms part of the base wall or plate 42. The motors are disposed on opposite sides of the forming assembly 33.

The end plate 46 extends perpendicularly from a location near, but inward from, the downstream end of the base wall 42. It should be noted that the terms "upstream" and "downstream" are herein used in relation to the direction of flow of the stock material through the machine 30. The end plate 46 is generally rectangular and planar and includes a dunnage outlet opening. The housing (or frame) 31 also includes a front cover or plate 49 which extends perpendicularly from the downstream edge of the base wall 42. Thus, the end plate 46 and front plate 49 bound upstream and downstream ends of a box-like extended portion of the downstream end of the housing 31. The front plate 49 may be a door-like structure which may be selectively opened to access cutting assembly components of the cutting assembly 38. The post cutting constraint 40 may be mounted to the front plate 49 and includes a tubular portion generally corresponding in cross-section to the cushioning product produced by the machine.

The base and side walls 42 and 44 have at the upstream end of the housing 31 inturned edge portions that form a rectangular border around a centrally located, and relatively large, rectangular stock inlet opening 51. This border may be viewed as an end plate or wall extending perpendicularly from the upstream edge of the base wall 42 and to which the stock supply assembly 32 is attached.

The illustrated stock supply assembly 32, thus located at the rear or upstream end (to the left in FIGS. 1 and 2) of the machine 30, includes a holder assembly 54 for a stock roll 55. The illustrated stock roll consists of three superimposed plies or layers 56–58 of biodegradable, recyclable and reusable thirty-pound Kraft paper rolled onto a hollow cylindrical tube. The stock roll may be supported by a spindle 60 or other stock roll holder device, such as that shown in U.S. patent application no. 08/267,960 between the lower ends of a pair of hanger brackets 61 provided, as shown, with slots 62 for receiving the ends of the spindle. The illustrated hanger brackets 61 (or hangers) have a double L or stepped configuration for use with the machine 30 when supported in a horizontal orientation as shown. It will be appreciated that the machine 30 may be otherwise oriented, such as vertically or at an incline, for different applications. Also, the stock roll holder assembly 54 need not be mounted to the machine housing as shown, but instead may be separate from the machine housing as in the form of a cart, especially when large and thus heavy stock rolls are used.

The upper risers or legs 63 of the stock roll hangers 61 are secured to the rear wall of the housing 31. The intermediate legs 64 extend horizontally away from the housing and the lower legs 65 depend from the outer ends of the intermediate legs. The hangers have journalled therebetween guide rollers 67 and 68 over which the superimposed layers of stock material are trained. Between the stock roll 55 and first guide roller 67, the superimposed layers of stock material are passed around a damper roller 70 which is biased to exert a tensioning force on the stock material being fed into the machine. In the illustrated embodiment, the damper roller is journalled between the ends of pivot arms 71 pivotally attached at 72 to the hangers 61, and the damper roller is biased by gravity, although other biasing arrangements may be used such as resilient spring biasing means. The dancer roller pivots about the pivot 72 of the pivot arms as the tension on the stock material is increased or decreased during unwinding of the stock material from the stock roll. This pivoting action, combined with the serpentine path determined by the guide rollers 67 and 68, dampens the effects of starting and stopping of the stock material feed mechanisms (hereinafter described) and thereby assists in maintaining a more uniform tension on the stock material.

From the guide roller 68, one layer 56 of the stock material, herein also referred to as an outer or first layer, passes to the entry or upstream end of the outer shaping assembly or device 34. The other layer or layers 57 and 58 of stock material, herein also referred to as an inner or second layer or layers, passes to separators 75–77 which separate the plies from one another. As shown, the separators are rollers journalled between the upper legs 63 of the hangers 61. From the separators, the inner layers pass to the entry end of the inner shaping assembly 33.

The inner shaping assembly shapes the inner layers of stock material into a stuffing for a tubular casing as the inner layers are fed through the inner shaping assembly by an inner feed assembly 80 that constitutes one of the aforesaid feed assemblies. In the illustrated embodiment the inner feed assembly is located downstream of the inner shaping assembly and thus pulls the inner layer through the interior of the inner shaping assembly.

With reference to FIGS. 1, 2, 4 and 5, the inner shaping assembly 33 includes a shaping chute 82 and a former 83 which cooperate to turn inwardly the edges of the inner layers to form a strip of pillow-like stuffing. The illustrated shaping chute (a converging chute as the cross section of the chute progressively decreases) and former are of the type shown in U.S. patent application no. 08/386,355, and the description and illustration thereof are hereby incorporated herein by reference. As will be appreciated, the converging chute has side walls which turn towards one another to roll lateral edge portions of the inner layers toward one another. In addition to this rolling action, the inner layers will crumple because of the progressively decreasing cross-section of the converging chute. The former 83 is in the form of a hair pin with one leg extending generally parallel with a center guide wall of the converging chute to define a relatively narrow guide channel for the center portion of the inner layers moving through the converging chute, whereby the center portion is held in close proximity to said center guide wall. The other leg of the hair pin is attached to the wall of the chute opposite the center guide wall and the former preferably has a rounded upstream end as shown in FIG. 1 for providing a smooth guide-in for the center portion of the inner layers.

Figure 3:
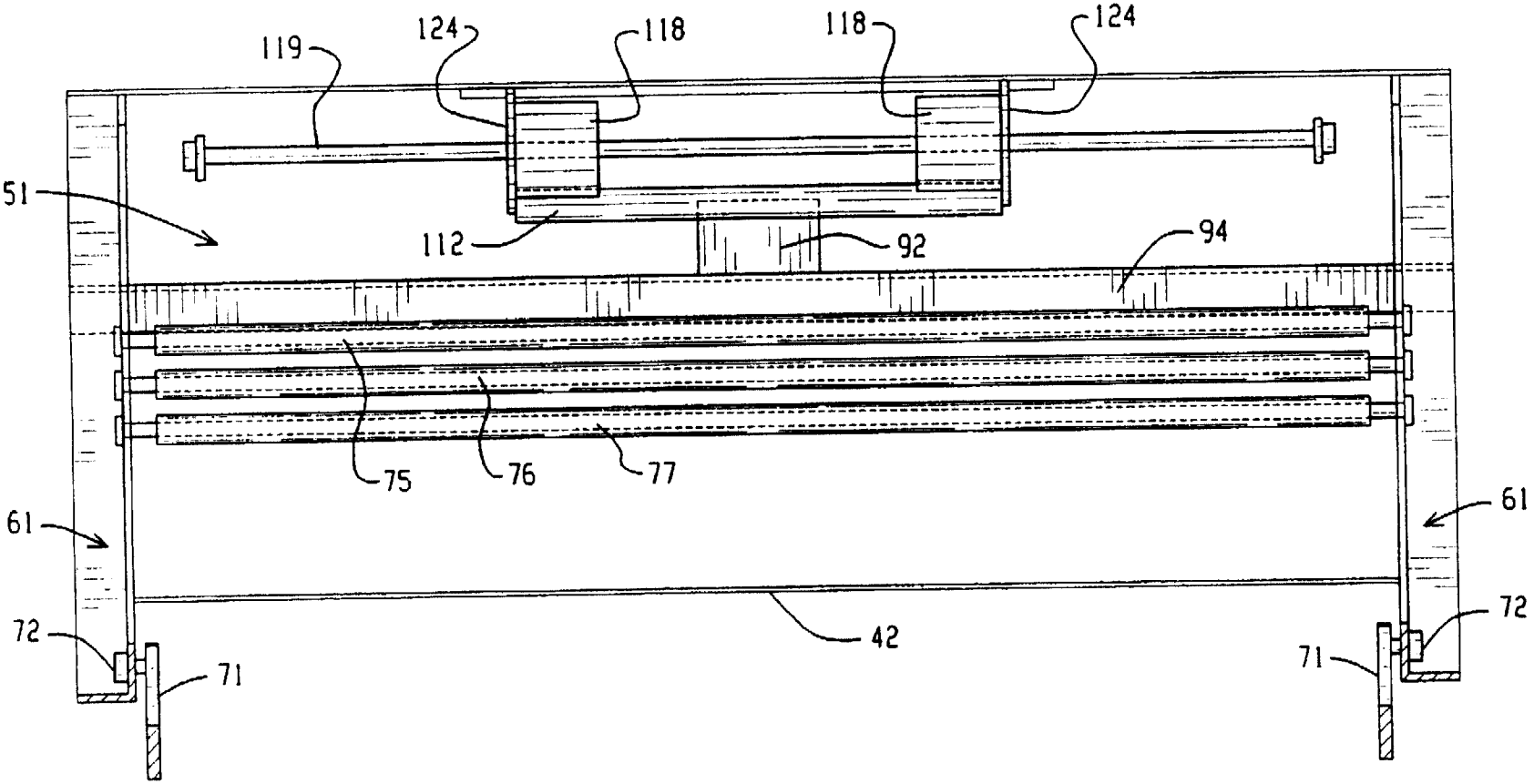
FIGS. 3–6 are sectional views of the machine of FIG. 1 respectively taken along the lines 3—3, 4—4, 5—5 and 6—6 of FIG. 1.
Figure 4:
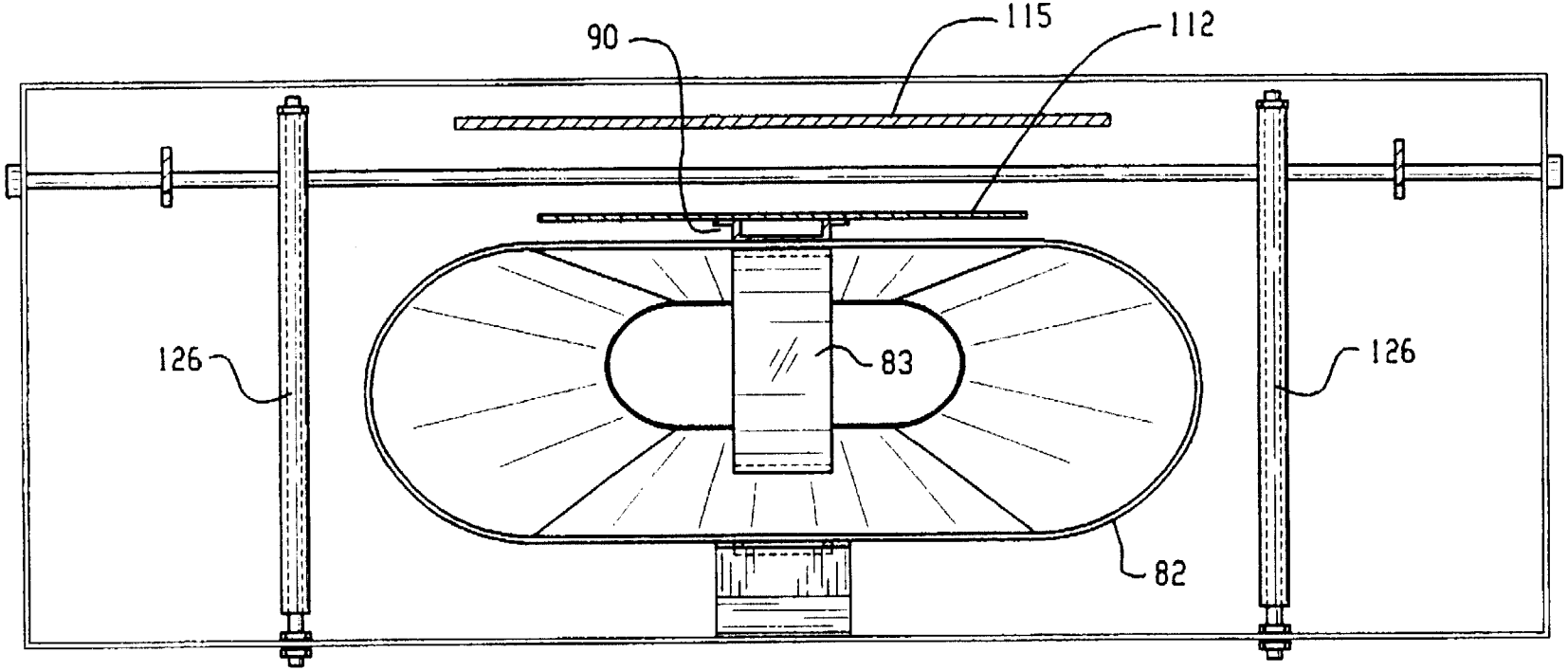

The chute 82 is mounted between a pair of supports 90 and 91 herein referred to as the upper and lower supports in view of their relative positions shown in the drawings and not to limit the machine to a horizontal orientation. As best shown in FIGS. 1 and 3, the upper support 90 is attached at its upstream end in cantilever-like manner to a short post 92 on a transverse frame member 94 extending between the side walls 44 of the housing 31. The lower support 91 is similarly attached at its upstream end in cantilever-like manner to a short post 96 secured to the bottom wall 42 of the housing. From their respective points of attachment, the cantilevered supports extend downstream in generally parallel, but slightly converging, relationship as shown in FIG. 1. The chute may be attached on opposite sides thereof (top and bottom in FIG. 1) to the upper and lower supports.

Figure 5:
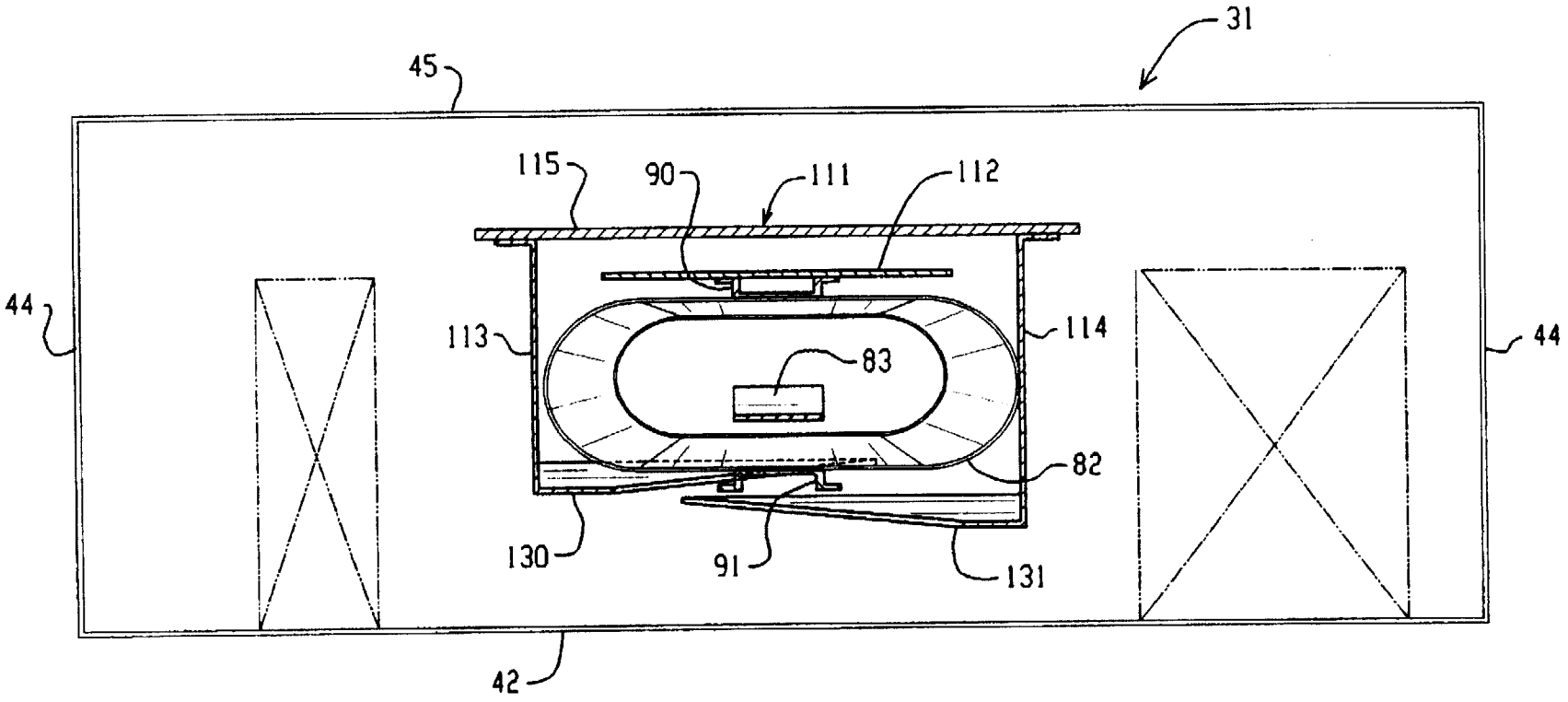
Figure 6:
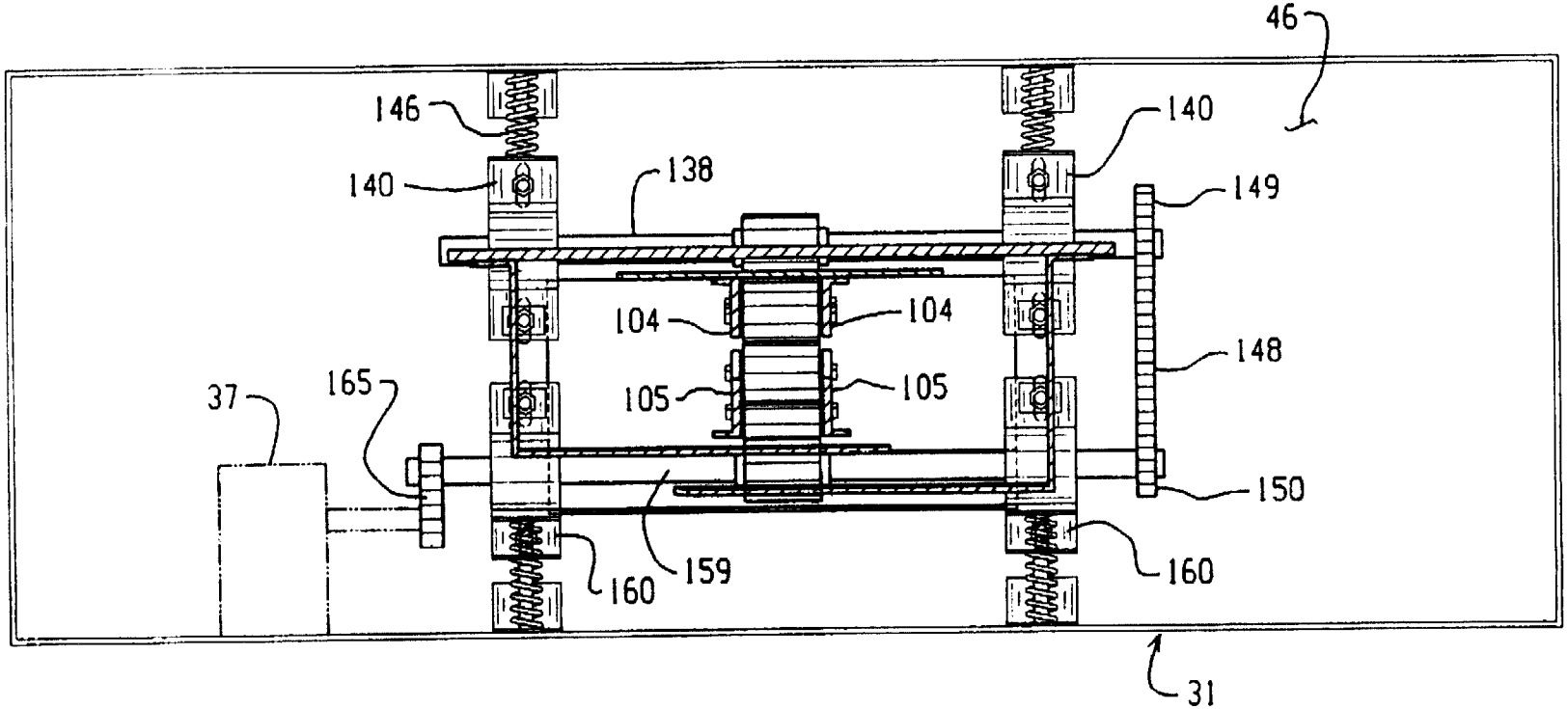
Figure 7:
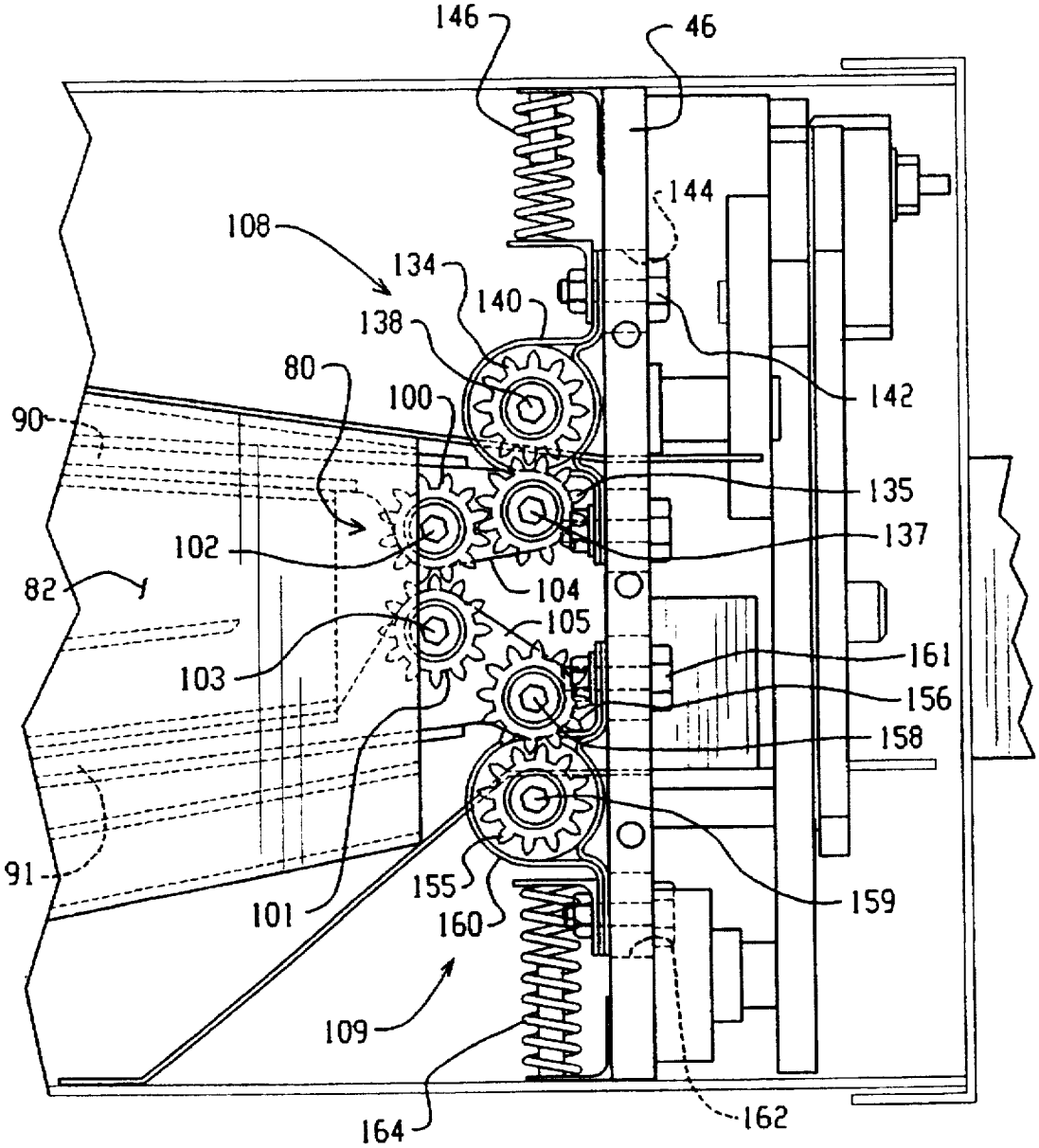
FIG. 7 is an enlarged fragmentary portion of FIG. 1.

Looking at FIG. 1, it will be appreciated that the transverse frame member 94 is offset from the path of the inner layers 57 and 58 from the separators 75–77 to the inner shaping assembly 33. For increased stiffness and strength, the supports preferably are fabricated as U-shape channel members having outwardly turned ears at the ends of the legs of the channel, as best shown in FIG. 5. The outwardly turned ears may provide for attachment to another member in the case of the upper support or may cooperate to form part of a guide surface for a layer of stock material passing thereover in the case of the lower support, For feeding the inner layers through the inner shaping assembly 33, the inner feed assembly, as best shown in FIGS. 6 and 7, includes a pair of rotating crumpling members 100 and 101 forming therebetween a nip through which a central region or band of the strip of stuffing formed from the inner layers pass and which is further crumpled and preferably loosely connected. The crumpling members preferably are toothed gear-like members similar to the gear-like members shown in U.S. Pat. No. 4,750,896. The crumpling members are mounted for rotation by shafts 102 and 103 extending between clevis-like extensions 104 and 105 at the downstream ends of the supports 90 and 91. As described further below, at least one of the crumpling members is rotatably driven, in this case the crumpling member 100. The supports hold the crumpling members with the teeth thereof in loosely meshed relationship for crumpling and loosely connecting the inner layers passing therebetween. As is preferred, the inner layers are loosely connected such that they can separate somewhat within the tubular casing formed therearound in the hereinafter described manner. This adds to the loft or reduced density of the finished cushioning or dunnage product.

Because of the length and an inherent resilient flexibility of the cantilever supports 90 and 91 (and the chute 82 which may be disposed therebetween), the crumpling members 100 and 101 are free to float towards and away from one another to accommodate different thicknesses of stock material between the crumpling members. Preferably, the amount of squeeze pressure applied by the crumpling members is adjustably controlled in the manner hereinafter described in connection with the outer shaping assembly to obtain a desired crumpling and loose connecting action.

Referring now to FIGS. 1–5, the outer shaping assembly 34 shapes the outer layer of the stock material into a tubular casing with the lateral edge portions being brought into overlapping relationship as the outer layer is fed through the outer shaping assembly by outer feed assemblies 108 and 109. In the illustrated embodiment the outer feed assemblies are located downstream of the outer shaping assembly and thus pull the outer layer through the interior of the outer shaping assembly. The outer shaping assembly includes a folding device 110 including an outer folding channel 111 and an inner folding plate 112 extending into the folding channel. The folding channel has converging side walls 113 and 114 depending from a laterally extending guide wall 115 which together form an inverted U-shape as best seen in FIG. 5.

The folding plate 112 has a rounded upstream or entry end over which the central region of the outer layer passes. The upstream end of the inner folding plate is narrower than the width of the outer layer such that lateral edge portions of the outer layer overhang the sides of the folding plate. From its upstream end the folding plate tapers to its narrower downstream end which has a width greater than the width of the downstream end of the converging chute 82 as best shown in FIG. 2. Also, the upstream end of the inner folding plate has a width less than the width of the downstream end of the folding channel such that the edges of the folder plate are spaced from the adjacent side walls 113 and 114 of the folding channel 111.

The outer layer is held against the rounded entry end of the folding plate 112 by a folder roller or rollers 118 which, in the illustrated embodiment, are held by gravity against the folding plate. As shown, two rollers are rotatably mounted on an axle or shaft 119 which extends transversely between the free ends of a pair of pivot arms 120. The pivot arms have their other ends pivotally connected to a transverse member 122 extending between the side walls 44 of the machine housing 31. This arrangement enables the folder rollers to be easily lifted clear of the inner folding plate to facilitate threading of the outer layer therebetween during loading on the machine.

The folder roller or rollers 118 preferably have annular flanges 124 (FIGS. 2 and 3) at the outer sides thereof which overhang respective side edges of the folder plate 112 for urging downwardly the lateral edge portions of the outer layer overhanging the folder plate. Further downward urging or folding of the lateral edge portions is effected by edge guides 126 (FIGS. 1, 2 and 4) extending generally perpendicularly to the folder plate and spaced from respective side edges of said folder plate at a location downstream of the upstream end portion of the folder plate and upstream of the side walls 113 and 114 of the folding channel 111. The edge guides, preferably rollers, assist in guiding the edge portions of the outer layer inwardly of the side walls of the folding channel while the central region of the outer layer is guided between the outer surface of the folder plate 112 and inner surface of the guide wall 115 of the folding channel, which guide wall preferably has an upstream extension extending to approximately the upstream end of the folder plate as best shown in FIG. 1. As also shown in FIG. 1, the guide wall and folder plate preferably converge towards one another going form their upstream to their downstream ends.

The side walls 113 and 114 of the folding channel 111 have along their edges opposite the guide wall 115 respective wings 130 and 131 inwardly turned toward one another as best shown in FIGS. 1, 2 and 5. The wings, which are triangular in shape, have the downstream ends thereof overlapped (see the broken line profile in FIG. 2) and spaced apart (FIGS. 1 and 5). The outer one 131 of the overlapped wings defines with the inner one 130 of said wings a first area for receiving one folded under edge portion of the outer layer of stock material, and the inner one of the wings defines with an outer surface of the shaping chute 82 a second area for receiving an opposite edge portion of the outer layer. Preferably, the wings converge toward the inner folder plate and guide wall. As the outer layer passes through the folding device, the outer lateral edge portions of the outer layer are folded in upon themselves to form a tubular casing surrounding the strip of stuffing exiting from the inner feed assembly.

For feeding the outer layer through the outer shaping assembly 34, the outer feed assembly 108, as best shown in FIGS. 6 and 7, includes a pair of rotating feed members 134 and 135 forming therebetween a nip through which a central region of the outer layer passes. The rotating feed members 134 and 135 preferably are toothed gear-like members similar to the gear-like members shown in U.S. Pat. No. 4,750,896. The inner rotating feed member 135 is mounted for rotation by a shaft 137 extending between the ears of the adjacent clevis-like extension 104 at the downstream end of the cantilevered support 90. The outer rotating feed member 134 is mounted to a shaft 138 which has the ends thereof supported in laterally spaced apart pillow blocks 140 which, if desired, may be joined together, as such by a laterally extending member, for uniform translating movement. The pillow block housings 140 are secured to the front plate 46 of the housing 31 by fasteners such as bolts 142 guided in respective slots 144 extending perpendicular to the path of the outer layer between the rotating feed members. Accordingly, the outer rotating feed member is movable transversely to the path of the outer layer. Each pillow block (bearing) housings, and thus the outer rotating feed member, is biased inwardly toward the inner rotating feed member by suitable resilient biasing means such as a spring 146 attached between the bearing housing and confronting housing structure as illustrated in FIGS. 6 and 7. As will be appreciated, the resilient biasing force acts through the meshing rotating feed members 134 and 135 to resiliently constrain outward flexing of the free end of the cantilevered support 90 and thus the respective rotating crumpling member 100.

The outer rotating feed member 134 is driven by the feed motor 37 (FIG. 1) in well known manner using a suitable drive train, which may include for example a chain 148 trained around a sprocket 149 on the shaft 138 and a driven sprocket 150, with a suitable resiliently biased take-up device (not shown) being used to take-up play in the chain that arises from movement of the shaft sprocket 149 relative to the driven sprocket 150. The outer rotating feed member 134 will rotatably drive the inner rotating feed member 135. The inner rotating feed member 135 is also meshed with the relatively adjacent one of the crumpling members 100 of the inner feed assembly 80 whereby such crumpling member will be rotatably driven synchronously with the outer feed assembly for feeding of the inner layers.

The other outer feed assembly 109 is similar to the feed assembly 108, but is referred to herein as the connecting assembly because it functions to connect together the overlapped lateral edge portions of the outer layer. The connecting assembly 109 includes a pair of rotating connecting members 155 and 156 forming therebetween a nip through which the overlapped lateral edge portions of the outer layer pass. The rotating connecting members preferably are toothed gear-like members of the type described in commonly assigned U.S. Pat. No. 4,968,291, which is hereby incorporated herein by reference, or any other pair of rotating devices that provide for secure stitching together of the outer layer edge portions, such as those disclosed in the application of Edwin P. Beierlorzer being filed even date herewith and entitled "Cushioning Conversion Machine for Converting Sheet-like Stock Material into a Cushioning Product", which is hereby incorporated herein by reference in its entirety. The gear-like members or gears shown in this patent operate to perforate or coin the overlapped lateral edge portions along a central band. Although not required or necessary desired for the rotating members of the other feed assemblies, the connecting metfibers 155 and 156 operate to provide a secure mechanical interference interlock between the overlapped lateral edge portions of the outer layer to form a connected tubular casing for the stuffing that has substantial holding resistance to "unzippering" of the thus formed stitched seam.

The inner rotating connecting member 156 is mounted for rotation by a shaft 158 extending between the ears of the adjacent clevis-like extension 105 at the downstream end of the cantilevered support 91. The outer rotating connecting member 155 is mounted to a shaft 159 which has the ends thereof supported in laterally spaced apart bearing housings 160. The bearing housings are essentially the same as the above described bearing housings 140 and are similarly mounted to the front plate 46 by bolts 161 guided in respective slots 162 extending perpendicular to the path of the outer layer between the rotating connecting members. Each bearing housing 160 is biased inwardly toward the inner rotating connecting member by a spring 164. As will be appreciated, the resilient biasing of the spring forces acts through the meshing rotating connecting members 155 and 156 to resiliently constrain outward flexing of the free end of the cantilevered support 91 and thus the respective rotating crumpling member 101. Thus, the free ends of both cantilevered supports 90 and 91 are resiliently constrained against outward flexing. However, it will be appreciated that such resilient constraint may also be effected even if the bearing mounts for one of the shafts 138 and 159 is fixed against movement relative to the frame. The amount of squeeze pressure applied by the crumpling members is adjustably controlled by adjusting the biasing force of the springs 146 and 164.

As shown in FIGS. 6 and 7, the shaft 159 is rotatably driven by the feed motor through a suitable drive train which may include a chain 165 trained around a sprocket on the shaft 159 and a driven sprocket, with a resiliently biased take-up being provided to accommodate movement of the shaft 159. Also, the sprocket 150 may be mounted to the shaft 159 as an expedient means for effecting synchronous rotation of the rotating members of the outer feed and connecting assemblies 108 and 109. As is further evident from FIG. 7, the outer feed assembly 100 and the connecting assembly 109 engage the outer layer at transversely aligned locations relative to a movement path of the first layer.

Although details of the method of forming a dunnage product according to the invention have been mentioned above in connection with the description of the structure of the machine, by way of summary a method according to the invention comprises the steps of shaping an outer layer of the stock material into a tube with the lateral edge portions being brought into overlapping relationship, connecting the overlapped lateral edge portions of the outer layer to form a tubular casing, shaping an inner layer or layers of the stock material into a stuffing for the for the casing, and feeding the stuffing into the interior of the casing. The overlapped lateral edge portions are generally coplanar with adjacent unoverlapped portions of said outer layer during the connecting step. Preferably, the layers of stock material comprise biodegradable, recyclable and reusable Kraft paper. Also, as is apparent from the foregoing description, the step of connecting the overlapped lateral edge portions includes using a pair of rotating connecting members forming therebetween a nip through which the overlapped lateral edge portions of the outer layer pass. Moreover, the feeding step uses the pair of rotating crumpling members forming therebetween a nip though which the inner layer or layers pass and are crumpled thereby.

The cutting assembly 38 is used to cut the thusly produced continuous strip at a desired length to form a cushioning product. In this manner, the length of the cushioning product may be varied depending on the intended application. The particular construction and operation of the strip-cutting assembly is not essential to the present invention. However, reference may be had to U.S. patent application, no. 08/110,349 for a cutting assembly similar to that illustrated.

Figure 8:
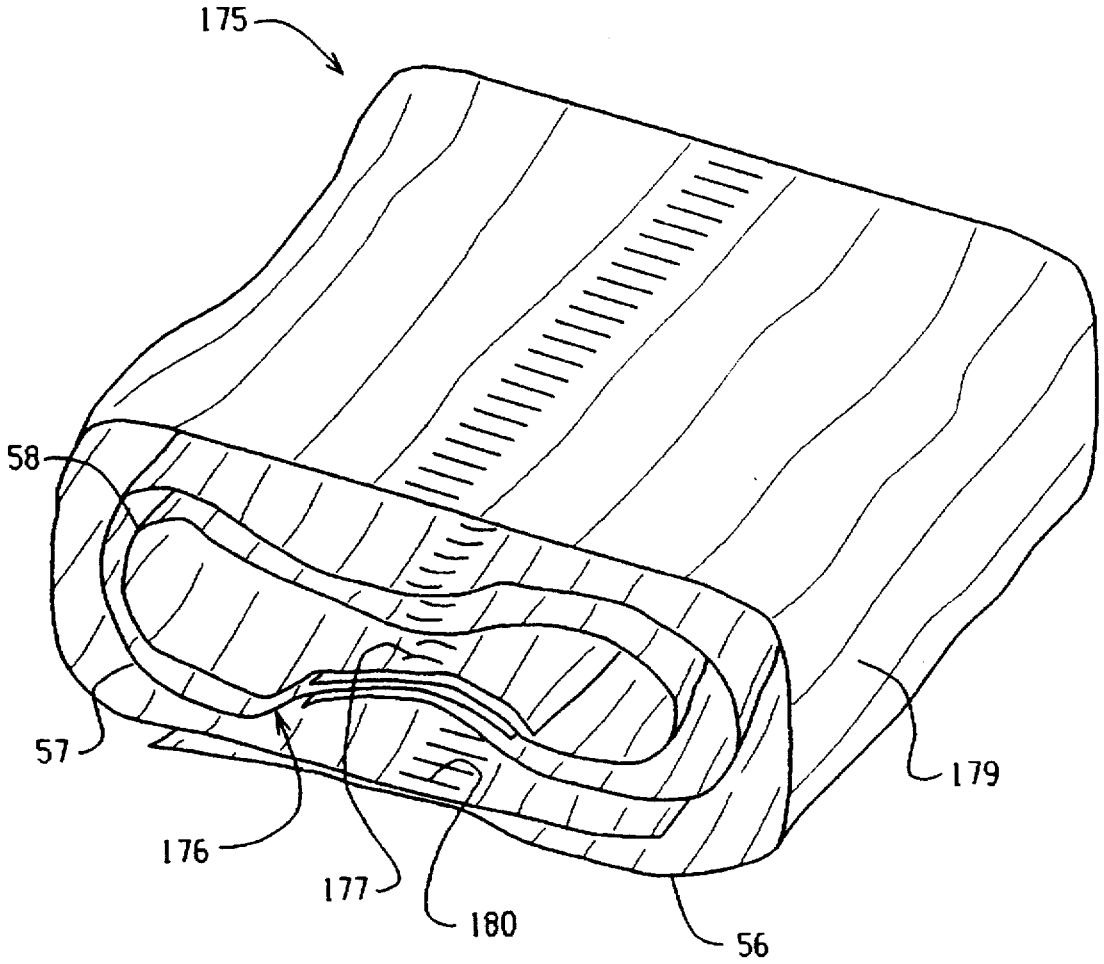
FIG. 8 is a schematic perspective view of a cushioning product according to the present invention.

Referring now to FIG. 8, a cushioning product according to the invention is schematically illustrated at 175. The cushioning product 175 comprises at least and preferably two, three or more inner layers 57 and 58 of sheet-like material having portions thereof folded upon themselves and crumpled to produce a stuffing 176 loosely connected along central band 177, and an outer layer 56 of sheet-like material formed into a tubular casing 179 surrounding the stuffing and having lateral edge portions overlapped and stitched together along a central band 180 separate from the stuffing 176. The overlapped lateral edge portions are generally coplanar with adjacent unoverlapped portions of the first layer, and the layers of stock material comprise biodegradable, recyclable and reusable Kraft paper, as above mentioned.

Although the invention has been shown and described with respect to certain preferred embodiments, it is obvious that equivalent alterations and modifications will occur to others skilled in the art upon the reading and understanding of this specification. The present invention includes all such equivalent alterations and modifications.

What is claimed is:

1. A method for converting stock material into a dunnage product having a casing and a stuffing within the casing, said method comprising the steps of:

supplying stock material including a casing layer, having lateral edge portions and a central portion, for forming the casing of the dunnage product, and a stuffing layer, for forming the stuffing of the dunnage product:

providing a first shaping device which shapes the casing layer of the stock material into the casing, providing a second shaping device which shapes the stuffing layer of the stock material into the stuffing;

providing an outer feed assembly for feeding the casing layer through the first shaping device;

providing an inner feed assembly, downstream of the second shaping device, for feeding the stuffing layer through the second shaping device using the outer feeding assembly to feed the casing layer to the first shaping device and thereby shaping the casing layer of the stock material into the casing for the dunnage product, this shaping including overlapping the lateral edge portions of the casing layer;

connecting the overlapped lateral edge portions of the casing layer; and using the inner feed assembly to feed the stuffing layer to the second shaping device and thereby shaping the stuffing layer of the stock material into the stuffing for the dunnage product;

said feeding of the stuffing layer being performed in a manner positioning the stuffing within the casing.

2. A method as set forth in claim 1, wherein said step of shaping the casing layer is performed in such a manner that the overlapped lateral edge portions of the casing layer are generally coplanar with adjacent unoverlapped portions of said casing layer during said connecting step.

3. A method as set forth in claim 2, wherein said supplying step includes supplying a stuffing layer that comprises a plurality of plies of stock material wherein said step of shaping the stuffing layer comprises shaping the plurality of plies.

4. A method as set forth in claim 3, wherein said supplying step includes supplying stock material that is biodegradable, recyclable and reusable Kraft paper.

5. A method as set forth in claim 1, wherein said step of connecting the overlapped lateral edge portions includes using first and second rotating connecting members forming therebetween a nip through which the overlapped lateral edge portions of the casing layer pass.

6. A method as set forth in claim 5, wherein said feeding step includes using first and second rotating crumpling members forming therebetween a nip though which the stuffing layer passes and is crumpled thereby.

7. A method as set forth in claim 6, wherein said first and second rotating connecting members each have a plurality of teeth and wherein the teeth on the first rotating connecting member interact with the teeth on the second rotating connecting member to stitch together the overlapped lateral edge portions.

8. A method as set forth in claim 7, wherein one of said first and second rotating connecting members is rotatably driven by the other of said first and second rotating connecting members.

9. A method as set forth in claim 8, wherein said first and second rotating crumpling members of said inner feed assembly each have a plurality of teeth.

10. A method as set forth in claim 1, wherein said step of shaping the stuffing layer includes using a folding device having first and second converging side walls and first and second wings extending inwardly from the first side wall and the second side wall, respectively, towards the second side wall and the first side wall, respectively, the first wing being overlapped and spaced apart from the second wing to fold the lateral edge portions of the casing layer into overlapping relationship.

11. A method as set forth in claim 1, wherein the step of supplying stock material comprises supplying a stuffing layer that comprises multiple plies and wherein said method further comprises the step of separating the multiple plies before said step of shaping the Stuffing layer.

12. A method as set forth in claim 1, wherein said step of shaping said stuffing layer includes passing said stuffing layer through a converging chute.

13. A method as set forth in claim 1, wherein said step of shaping said stuffing layer includes using a former to shape the stuffing layer and hold a central portion thereof adjacent one side of said converging chute.

14. A cushioning conversion machine for converting stock material into dunnage product having a casing and a stuffing within the casing, said machine comprising:

a stock supply which supplies stock material including a casing layer of stock material having a central portion and lateral edge portions and a stuffing layer;

a first shaping device which shapes the casing layer of the stock material into the casing with the lateral edge portions of the casing layer being brought into overlapping relationship;

a second shaping device which shapes the stuffing layer of the stock material into the stuffing;

an outer feed/connecting assembly which feeds the casing layer through said first shaping device and which includes a connecting assembly downstream of said first shaping device for connecting the overlapped lateral edge portions of the casing layer; and an inner feed assembly downstream of said second shaping device for feeding the stuffing layer through said second shaping device.

15. A conversion machine as set forth in claim 14, wherein said connecting assembly also pulls the overlapped edge portions of the casing layer and wherein the outer feed/connecting assembly further comprises an outer feed assembly positioned downstream of the stock supply assembly for pulling the central portion of the casing layer, whereby said outer assembly and said connecting assembly are cooperative to pull the casing layer through said first shaping device.

16. A conversion machine as set forth in claim 15, wherein said outer feed assembly and said connecting assembly are positioned at transversely aligned locations about a longitudinal axis.

17. A conversion machine as set forth in claim 15, wherein said connecting assembly includes first and second rotating connecting members forming therebetween a nip through which the overlapped lateral edge portions of the casing layer pass, said outer feed assembly includes inner and outer rotating feed members forming therebetween a nip through which the central portion of the casing layer passes, and said inner feed assembly includes inner and outer rotating crumpling members forming therebetween a nip though which the stuffing layer passes and is crumpled thereby.

18. A conversion machine as set forth in claim 17, further comprising a frame structure and first and second supports attached in a cantilever-like manner to said frame structure and respectively extending on Opposite sides of said second shaping device from an upstream end of said first shaping device to a downstream end of said first shaping device; and wherein:

said first and second rotating crumpling members of said inner feed assembly are mounted to downstream ends of the first and second supports, respectively said inner rotating connecting member of said connecting assembly is mounted to the downstream end of said first support; and said inner rotating feed member of said outer feed assembly is mounted to the downstream end of said second support.

19. A conversion machine as set forth in claim 18, wherein, said outer rotating connecting member and said outer rotating feed member are transversely movable relative to one another and are resiliently biased towards one another for resiliently constraining the downstream ends of said supports against movement away from one another, whereby the rotating crumpling members of said inner feed assembly are resiliently constrained against movement away from one another.

20. A conversion machine as set forth in claim 18, wherein said outer rotating connecting member and said outer rotating feed member are mounted to said frame for transverse movement and are resiliently biased towards one another and respectively against said inner connecting member and said inner feed member for resiliently constraining the downstream ends of said supports against movement away from one another, whereby said first and second rotating crumpling members of said inner feed assembly are resiliently constrained against movement away from one another.

21. A conversion machine as set forth in claim 17, wherein said inner and outer rotating connecting members each have a plurality of teeth and wherein the teeth on the inner rotating connecting member interact with the teeth on the outer rotating connecting member to stitch together the overlapped lateral edge portions.

22. A conversion machine as set forth in claim 21, wherein one of said inner and outer rotating connecting members is rotatably driven by the other of said inner and outer rotating connecting members.

23. A conversion machine as set forth in claim 22, wherein the teeth of the inner rotating connecting member are in meshed relationship with the teeth of the outer rotating connecting member such that rotational motion is transmitted between the first and second rotating connecting members.

24. A conversion machine as set forth in claim 14, wherein said inner feed assembly includes first and second rotating crumpling members forming therebetween a nip through which the stuffing layer passes.

25. A conversion machine as set forth in claim 24, further comprising a frame and first and second supports attached in cantilever manner to said frame and wherein said first and second rotating crumpling members of said inner feed assembly are mounted to the downstream ends of said first and second supports, respectively and wherein said first and second supports respectively extend on opposite sides of said second shaping device.

26. A conversion machine as set forth in claim 25, wherein said connecting assembly includes first and second rotating connecting members forming therebetween a nip through which the overlapped lateral edge portions of the casing layer pass.

27. A conversion machine as set forth in claim 26, wherein said first and second rotating connecting members each have a plurality of teeth and wherein the teeth on said first rotating connecting member interact with the teeth on said second rotating connecting member to stitch the overlapped lateral edge portions together.

28. A conversion machine as set forth in claim 27, wherein one of said first and second rotating connecting members is rotatably driven by the other of said first and second rotating connecting members.

29. A conversion machine as set forth in claim 28, wherein the teeth of said first rotating connecting member are in meshed relationship with the teeth of said second rotating connecting member such that rotational motion is transmitted between said first and second rotating connecting members.

30. A conversion machine as set forth in claim 24, wherein said outer feed/connecting assembly includes inner and outer rotating members forming therebetween a nip through which a portion of the casing layer passes, said first and second rotating members each having teeth thereon, the teeth of the first rotating member being in meshed relationship with the teeth of the second rotating member such that rotational motion of said outer rotating member is transmitted to said inner rotating member, and said inner rotating member is drivingly connected to one of said first and second rotating crumpling members of said inner feed assembly, whereby rotation of said outer rotating member rotates said inner rotating member which in turn effects rotation of said one of said first and second rotating crumpling members.

31. A conversion machine as set forth in claim 24, wherein said first and second rotating crumpling members of said inner feed assembly each have a plurality of teeth.

32. A conversion machine as set forth in claim 14, wherein said first shaping assembly includes a folding device having first and second converging side walls and first and second wings extending inwardly from the first and second side walls, respectively, towards the second and first side walls, respectively, said first wing being overlapped and spaced apart from the second wing.

33. A conversion machine as set forth in claim 32, wherein said first wing defines with said second wing a first area for receiving one of the edge portions of said casing layer, and said second shaping device has a first surface defining with said second wing a second area for receiving the opposite one of the edge portions of said casing layer.

34. A conversion machine as set forth in claim 33, wherein said folding device further includes an inner folder surface and an outer center guide surface extending laterally between said first and second side walls and defining therebetween a passage for the central portion of said casing layer, and wherein said inner folder surface has side edges spaced from said side walls.

35. A conversion machine as set forth in claim 34, wherein said first and second wings converge toward said inner folder and outer center guide surfaces.

36. A conversion machine as set forth in claim 34, including at least one roller which holds the casing layer against an upstream end portion of said inner folder surface.

37. A conversion machine as set forth in claim 36, including edge guides extending generally perpendicular to said inner folder surface and spaced from said side edges of said inner folder surface at a location downstream of said upstream end portion of said inner folder surface and upstream of said first and second side walls of said folding device.

38. A conversion machine as set forth in claim 14, further comprising at least one separator member interposed between the respective paths of the casing layer and the stuffing layer upstream of said first and second shaping devices.

39. A conversion machine as set forth in claim 14, wherein said inner feed assembly includes first and second rotating crumpling members forming therebetween a nip through which the stuffing layer passes and is crumpled thereby.

40. A conversion machine as set forth in claim 39, further comprising a frame and first and second supports attached in cantilever-like manner to said frame and respectively extending on opposite sides of said second shaping device from an upstream end of said first shaping device to a downstream end of said first shaping device and wherein said first and second crampling members are mounted to downstream ends of said first and second supports, respectively.

41. A conversion machine as set forth in claim 40, wherein said second shaping device includes a converging chute mounted between said first and second supports.

42. A conversion machine as set forth in claim 14, wherein said second shaping device includes a converging chute and a former which cooperate to turn inwardly portions of the stuffing layer to form a pillow stuffing shape.

* * * * *